US005370594A

United States Patent [19]

Grinblat

[11] Patent Number: 5,370,594

[45] Date of Patent: Dec. 6, 1994

[54] ADJUSTABLE AND CONFIGURABLE EXERCISE MACHINE

[76] Inventor: Arkady G. Grinblat, 114 Pleasant St., No. 103, Arlington, Mass. 02174

[21] Appl. No.: 243,384

[22] Filed: May 16, 1994

[51] Int. Cl.[5] ..... A63B 21/00

[52] U.S. Cl. ..... 482/72; 482/96

[58] Field of Search ..... 482/72, 73, 95, 96, 482/93, 94, 97, 142, 133, 121, 122, 125

[56] References Cited

U.S. PATENT DOCUMENTS

| | | | |
|---|---|---|---|
| 2,642,288 | 6/1953 | Bell | 482/96 |
| 2,924,456 | 2/1960 | Miller | 482/96 |
| 4,616,825 | 10/1986 | Anderson | 482/72 |
| 4,743,010 | 5/1988 | Geraci | 482/72 |
| 5,178,599 | 1/1993 | Scott | 482/96 |
| 5,299,997 | 4/1994 | Chen | 482/72 |

*Primary Examiner*—Stephen R. Crow
*Attorney, Agent, or Firm*—Charles Bickoff

[57] ABSTRACT

An adjustable and configurable exercise machine having a base sitting on the floor to which is pivotally attached an adjustable seat mechanism. Attached to the seat mechanism at a point located between the pivotally attached end and the seat is an arm actuated handle. Near the pivot is an adjustable pivot point to which is attached an adjustable control link. The purpose of the adjustable pivot point is to change the leverage ratio and the purpose of the adjustable control link is to change the position of the handle relative to the user. The second end of the adjustable control link is attached to a vertical upright member of the base frame assembly. A counter force capability is provided to counter the weight of the user. The user in a first use sits on the seat astride the machine with the feet on the foot rests and pulls with the arms and pushes with the feet. In a second use the pivot pin attaching the adjustable control link to the seat mechanism is removed and the handle is rotated against the seat. The user stands at the rear facing forward with the hands upon the transverse handle bar and pushes the handle downward against the counterforce thus promoting exercise. In a third exercise the user sits on the floor behind the machine with the handle bar also collapsed against the seat. The feet are placed against the rear of the foot rests with the heels on the floor and the hands grasp the transverse handle and pull the bar downward

16 Claims, 4 Drawing Sheets

ADJUSTABLE AND CONFIGURABLE EXERCISE MACHINE

BACKGROUND

The invention relates to the class of machines used to promote aerobic and muscle building exercise. In particular, this machine, in its simplicity, offers a high degree of adjustability to size the device to the physiology of the individual and tailor the force characteristics to accommodate varying effort needs. Prior machines have used complex linkages or sliding based mechanisms in their attempts to achieve this objective. This machine is designed around an easily adjustable four bar linkage combined with an adjustable and configurable counterbalance force function. The tailoring of this counterbalance force increases or decreases the effort and thus moves between aerobic and muscle building effort. The counterbalance force more particularly is provided by robber extension springs. Additionally, it may be sized to the exercising individual by adjusting seat position and handle position through the adjustment of the control link length.

The invention described herein offers improvements over the prior art in its simple construction, variable counter force configureability, adjustable sizing, and collapsibility for compact storage.

THE INVENTION OBJECTIVES

Several objects and advantages of the present invention include:

a. providing a means to size the exercise machine to the stature of the exercising individual by adjusting the seat position.

b. providing a machine structure which permits non-complex adjustment of the counter balance force. Such a motion structure is a four bar linkage with a variable length link and changeable pivot position.

c. providing a means to counterbalance the weight of the exercisee through adjusting the length of one of the four linkage bars, changing the leverage, and adding or subtracting springs.

d. providing a means to adjust the handle position through adjusting the length of a second of the four linkage bars.

e. providing a mechanism which can be easily disassembled or collapsed for storage.

A further object of the invention is to provide oversize foot rests to allow for repositioning of the feet and proportioning the exercise between the arms and legs.

It is another object of the invention to provide an exercise machine which provides for the removal or folding of the vertical members to allow flat storage of the machine.

Additional objects will be obvious to those skilled in the art from the drawings and detailed description which follows.

DRAWINGS

SUMMARY

Figure 1:
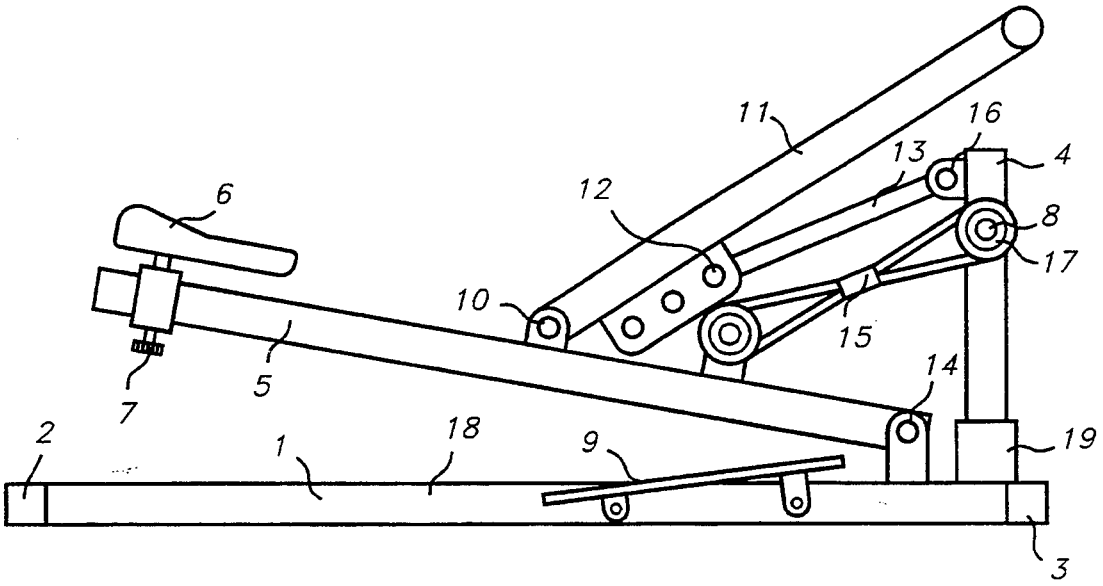
FIG. 1 is a Side Elevation of the Exercise Machine when viewed in the down position.

The invention herein described is for an exercise machine, the use of which is to promote aerobic and muscle building exercise while minimizing the impact upon joints caused by exercises such as jogging or high impact aerobics. In one exercise, the individual is positioned astride the seat with the feet placed upon the foot rests and hands grasping the handle. Exercise is accomplished by pulling on the handle and pushing with the legs upon the foot rests. In a second exercise, the pivot pin that attaches the adjustable link to the handle is removed and the handle is pivoted against the seat. The individual stands behind the machine facing forward, places the hands upon the transverse handle, and pushes downward with the arms. In a third exercise using the machine as described in exercise two, the individual sits with the buttocks on the floor adjacent to the rear stabilizing bar of the base facing forward with the heels on the floor and the feet placed against the rear of the foot rests. The user places the hands upon the handle transverse and pulls the handle bar downward. These exercises stress different muscle groups and through adjusting the spring force and leverage various levels of aerobic and muscle building are accomplished.

The amount of effort is controlled by the magnitude of the counterbalance force and its characteristics, the position of the control link pivot, and the length of the control link which positions the handle. Two force adjustments are provided. The first is through the repositioning of a first pivot located near the base of the handle longitudinal member. The location of this pivot point may be adjusted to vary the mechanical advantage and effect a fine force adjustment. Movement of the pivot point toward the handle increases effort, while movement toward the base of the handle longitudinal member decreases effort. A second principal means of increasing or decreasing effort is through the addition or deletion of springs or weights. This action effects large changes in the counterforce.

An additional feature of the machine is accomplished through the provision of oversized foot rests. These are disproportionately long for the purpose of locating the feet at various positions along the length. If the feet are placed toward the rear of the foot rests, the exercise stress will be placed more heavily upon the legs and less strenuously upon the arms. If the feet are placed toward the front of the foot rests, the effort will be shifted more to the arms find less to the legs. It will be obvious to those skilled in the art that marks or heel positioning devices may be placed upon the foot rests to aid in positioning the feet for exercise effort proportioning. It will also be obvious that shorter foot rests that are moveable would yield the same feature.

DETAILED DESCRIPTION OF THE BEST MODE

The following detailed description illustrates the invention by way of example, not by way of limitation of the principles of the invention. The description will clearly enable one skilled in the art to make and use the invention. It describes several embodiments, variations, and adaptations including what I believe to be the best mode.

Figure 3:
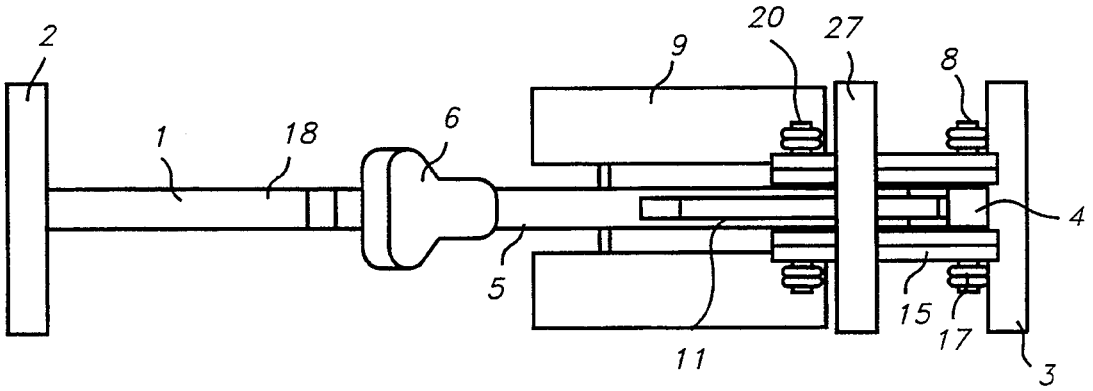
FIG. 3 is a Top Plan View of FIG. 2.
Figure 2:
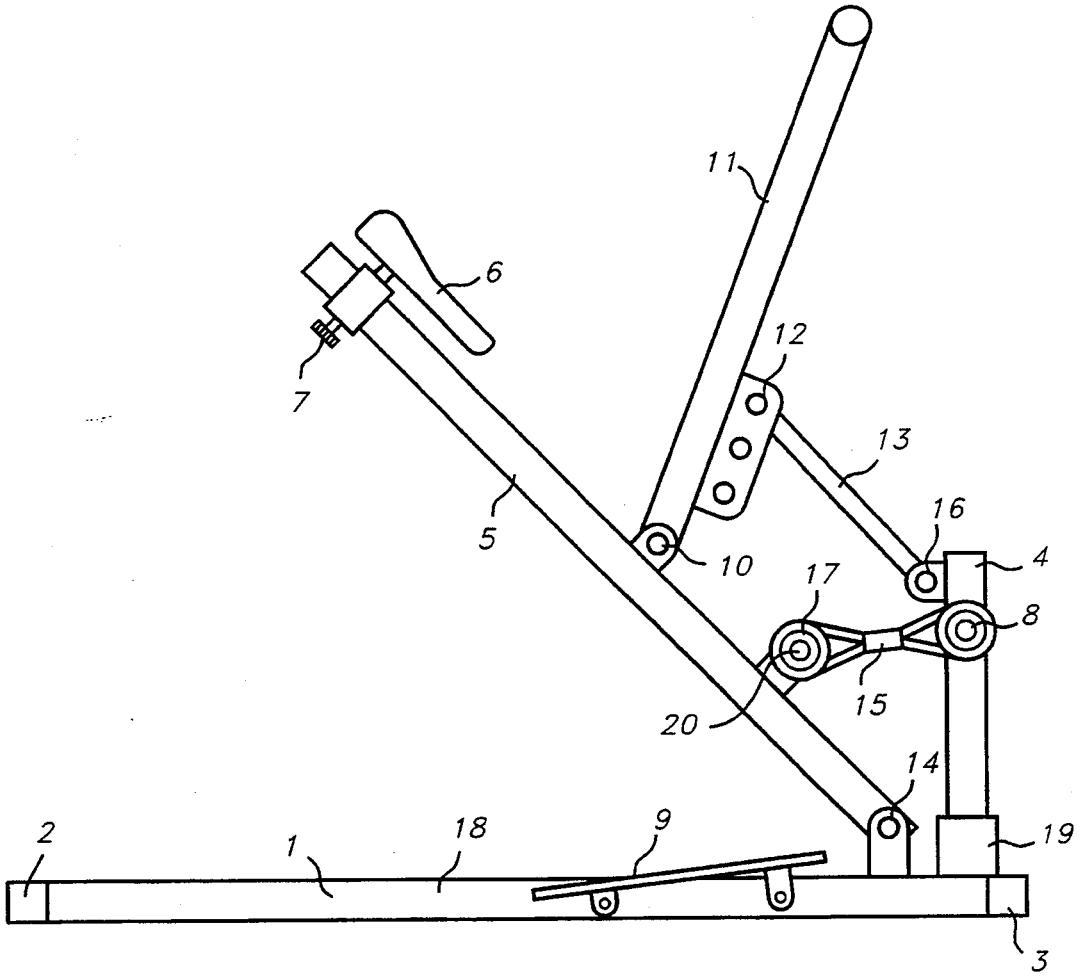
FIG. 2 is a Side Elevation of the Exercise Machine when viewed in the up or unloaded position.
Figure 4:
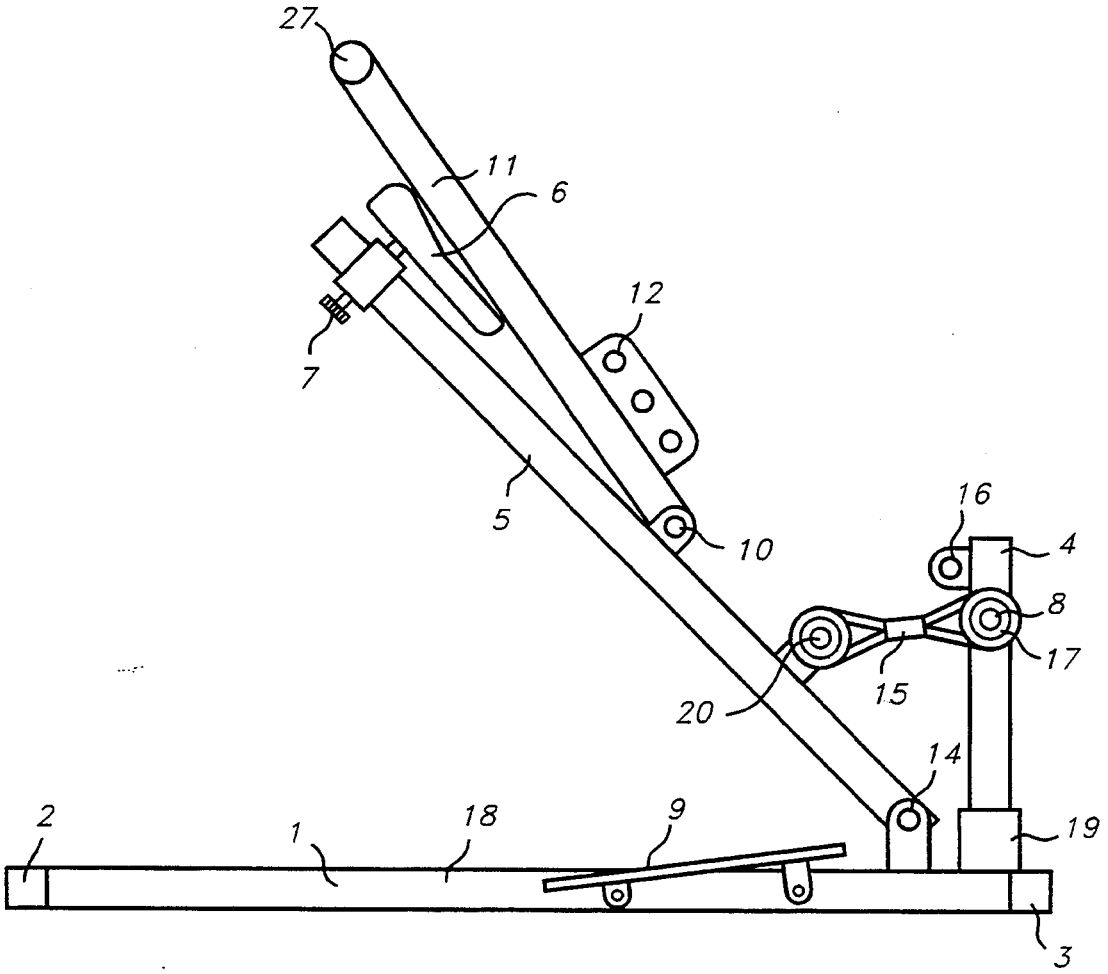
FIG. 4 is a Side Elevation showing the machine of FIG. 2 having the handle bar released and pivoted on top of the seat to provide other exercise options.

The preferred embodiment of the exercise machine is depicted in FIGS. 1-3 and is generally indicated in these figures as numeral 1. The exercise machine depicted in FIGS. 1-3 consists of a base portion having a longitudinal member 18, a first transverse member 2 at the rear end, and a second transverse member 3 located at the front end. Attached to the longitudinal member 18 are a pair of overly long foot rests 9, one located on either side. Said base portion is floor engaging. At the front end of the longitudinal member 18 of the base portion is a first pivot 14 and nearer the front end is a receiver 19 to accept a vertical post member 4.

The exercise machine is based upon a four bar linkage defined by a first bar, seat support bar 5, with the active bar defined by pivots 10 and 14, a second bar, handle 11, with the active bar defined by pivots 10 and 12, a third bar, adjustable control link 13, with the active bar defined by pivots 12 and 16, and a fourth bar defined by pivots 16 and 14.

Said seat support bar 5 extends rearward beyond the pivot 10 to an adjustably mounted seat means 6. Said seat means is fixedly positioned to the seat support means by an adjustable clamp means 7. The nature of the clamp means are well known in the art and may be a thumb screw clamp, indexing pin, rack and pinion, or other suitable means.

A first end of the handle means 11 is pivotally attached to the seat support means at pivot 10 and a second end having a transverse member to serve as a gripping member for the hands of the exercising individual. Said handle means is pivotally attached at adjustable pivot 12 to a first end of an adjustable control link 13. The adjustable pivot means may be implemented as a series of holes to which the pivot pin may be moved. In the alternative as will be recognized by those skilled in the art, the pivot may be moved by other means such as a lead screw mechanism or other suitable means. Moving pivot 12 toward pivot 10 increases the leverage and reduces the exercise effort, while moving pivot 12 toward the transverse handle decreases the leverage and increases the exercise effort. Said adjustable control link 13 may be implemented as a turnbuckle or with other suitable well known methodologies. The adjustment of the control link positions the handle in an appropriate position for exercise. Extending the control link rotates the handle means about pivot 10 toward the seat 6, while shortening the control link 13 rotates the handle means away from the seat.

A second end of the adjustable control link is pivotably attached to the vertical post member 4 by pivot 16 completing the four bar linkage. Finally, a plurality of counterforce application means 15 are attached at a first anchor 8 located on vertical post member 4 and a second anchor 20 attached to seat support means 5. It will also be recognized that the force application means could suitably be attached to handle means 12 and adjustable control link 13.

Figure 5:
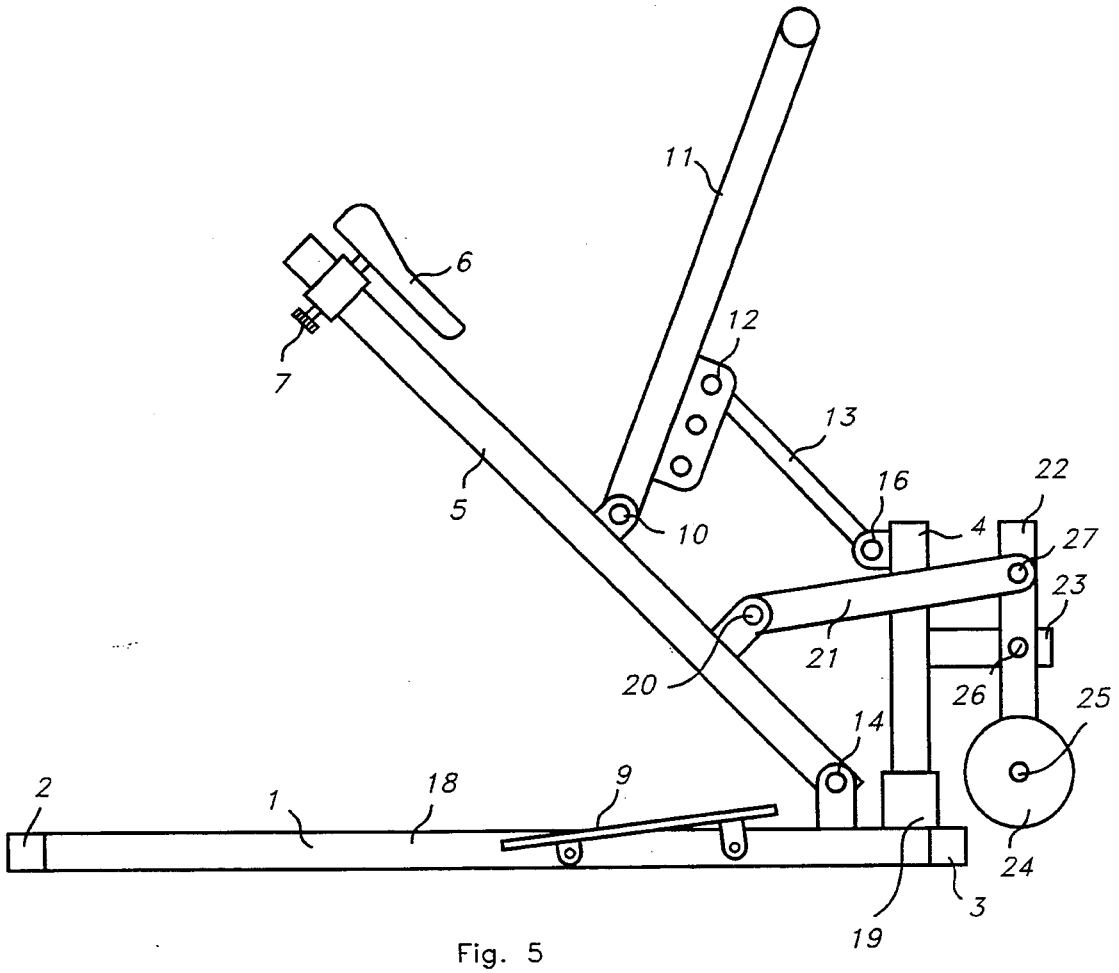
FIG. 5 is a Side Elevation showing a counterbalance weight.

In the alternative said force application means is replaced by a connecting link 21, weight pivot bar 22, and weight means 24 as shown in FIG. 5. Said weight means is mounted on a weight hanger 25. As the handle means is rearwardly rotated, the seat support means is lowered thereby pulling the first end of the connecting link 21 rearward. The second end of the connecting link is pivotally connected to the weight pivot bar 22 and rotating the weight pivot bar and weight means counter-clockwise when pivoted about pivot pin 26. It will be recognized by those skilled in the art that a plurality of pivot holes could be provided for pivot pin 26 to vary the effective weight means through a change in leverage as well as adding additional weights to the weight support 25, Additionally a weight means could be slid on to the transverse handle to provide the counterbalance function.

The above described counterbalance force means both have the characteristic of increasing the applied force proportional to the elongation of the spring-like devices or the rotation of the weight pivot bar and weight means.

In a first use, the individual sits on the seat means 6 and places his or her hands upon the transverse member of the handle means 11. The feet are placed upon the foot rest 9. The weight of the individual, partially counterbalanced by force application means 15, lowers the seat to the position shown in FIG. 1. As the seat support means is lowered, the counterbalance force means increases thereby aiding the individual to pull them selves up as the four bar linkage flattens. By pressing upon the foot rests 9 with the legs and pulling upon the transverse member 27 of the handle 11 with the arms, exercise is accomplished. Repositioning the feet along the length of the oversized foot support means 9 proportions the effort between the legs and arms.

In a second use the pivot pin 12 connecting the adjustable control link 13 to the handle means 11 is removed. Optionally, the entire control link 13 can be removed. The handle means is rotated to lay against the seat means 6. Two exercise positions are possible. In the first the user stands at the rear facing forward. The hands are placed upon the handle transverse member 27 and the user pushes the handle downward. In the second the user sits at the rear of the machine facing the front with the feet braced against the rear of the foot rests 9 and the heels on the floor, places the hands upon the handle transverse member 27 and pulls the handle bar toward the floor. These exercises stress different muscle groups in either an aerobic or muscle building mode depending upon the magnitude of the counterbalance force.

As will be obvious to persons skilled in the art, various modifications, adaptations, and variations of the specific disclosure can be made without departing from the teaching of the invention.

Having thus described this invention, what is claimed is:

1. An exercise machine comprising:

a floor engaging base support means;

said floor engaging base support means having a pair of foot supporting foot rest means located on each side of a longitudinal member of said floor engaging base support means;

a vertical member having a first end affixed to a forward end of said floor engaging base support means;

a seat support means having a first pivotally attached end near the forward end of the longitudinal member of said floor engaging base support means;

said seat support means having a seat means proximate to a second end of said seat support means;

an arm actuated handle member having a first end pivotally attached mid-proximate to said seat support means and a second end having a transverse handle bar means;

a control link having a first end pivotally attached to said handle member;

said control link having a second end pivotally attached to the vertical member at a second end;

a tension counterforce means having a first end affixed proximate to the second end of said vertical member and a second end attached to an anchor located between said mid-proximate pivot of said seat support means and the first pivotally attached end of said seat support means;

the arm actuated handle member being pulled by arms and the foot supporting foot rest means being pushed against by a user's legs with a buttocks of a user engaged with the seat means lifting the weight of the user partially counterbalanced by the tension counterforce means.

2. The exercise machine according to claim 1 wherein the position of the pivotally attached first end of the control link is adjustable with reference to the first end of the arm actuated handle member.

3. The exercise machine according to claim 2 wherein the length of the control link is adjustable.

4. The exercise machine according to claim 3 wherein a plurality of spring-like devices arranged in parallel provide the counterbalance force.

5. The exercise machine according to claim 4 wherein the pair of foot supporting foot rests are oversized;

the user shifting a greater portion of the load to the legs by positioning feet to the rear of said foot supporting foot rests and;

shifting a greater portion of the load to the arms by positioning the feet to the forward end of said foot supporting foot rests.

6. The exercise machine according to claim 5 wherein the vertical member is removable.

7. The exercise machine of claim 6 wherein the pivot pin attaching the adjustable control link to the seat support means is removed and the handle means is rotated to rest against the seat means;

the arm actuated handle member being pushed downward by the user standing at the rear facing forward with the hands gripping the transverse handle bar means.

8. The exercise machine of claim 7 wherein the pivot pin attaching the adjustable control link to the seat support means is removed and the handle means is rotated to rest against the seat means;

the arm actuated handle member being pulled downward by the user sitting floor engaging at the rear with feet engaged with the tear of the foot supporting foot rests and the hands gripping the transverse handle bar means.

9. An exercise machine comprising:

a floor engaging base support means;

said floor engaging base support means having a pair of foot supporting foot rests means located on each side of a longitudinal member of said floor engaging base support means;

a vertical member having a first end affixed to a forward end of said floor engaging base support means;

a seat support means having a first pivotally attached end near the forward end of the longitudinal member of said floor engaging base support means;

said seat support means having a seat means proximate to a second end of said seat support means;

an arm actuated handle member having a first end pivotally attached mid-proximate to said seat support means and a second end having a transverse handle bar means;

a control link having a first end pivotally attached to said handle member;

said control link having a second end pivotally attached to the vertical member at a second end;

a weight counterforce means having a first end of a weight control link attached to an anchor located between said mid-proximate pivot of said seat support means and the first pivotally attached end of said seat support means and a second end pivotally attached to a first end of a weight pivot arm;

said pivot arm pivotally attached proximate a mid point to a perpendicular frame extension and having a second end having a transverse weight hanger;

said weight hanger having a weight means attached;

the arm actuated handle member being pulled by the arms and the foot supporting foot rest means being pushed against by a users legs with a buttocks of a user engaged with the seat means lifting the weight of the user partially counterbalanced by the weight counterforce means.

10. The exercise machine according to claim 9 wherein the position of the pivotally attached first end of the control link is adjustable with reference to the first end of the arm actuated handle member.

11. The exercise machine according to claim 10 wherein the length of the control link is adjustable.

12. The exercise machine according to claim 11 wherein a plurality of weight-like devices arranged on the transverse weight hanger provide the counterbalance force.

13. The exercise machine according to claim 12 wherein the pair of foot supporting foot rests are oversized;

the user shifting a greater portion of the load to the legs by positioning feet to the rear of said foot supporting foot rests and;

shifting a greater portion of the load to the arms by positioning the feet to the forward end of said foot supporting footrests.

14. The exercise machine according to claim 13 wherein the vertical member is removable.

15. The exercise machine of claim 14 wherein the pivot pin attaching the adjustable control link to the seat support means is removed and the handle means is rotated to rest against the seat means;

the arm actuated handle member being pushed downward by the user standing at the rear facing forward with the hands gripping the transverse handle bar means.

16. The exercise machine of claim 15 wherein the pivot pin attaching the adjustable control link to the seat support means is removed and the handle means is rotated to rest against the seat means;

the arm actuated handle member being pulled downward by the user sitting floor engaging at the rear with feet engaged with the rear of the foot supporting foot rests and the hands gripping the transverse handle bar means.

* * * * *